United States Patent [19]

Obara et al.

[11] 4,239,944

[45] Dec. 16, 1980

[54] SPIDER OF LOUDSPEAKER

[75] Inventors: Isao Obara; Atsuya Kamada, both of Kamakura; Aizo Kaneda, Yokohama, all of Japan

[73] Assignee: Hitachi, Ltd., Japan

[21] Appl. No.: 5,247

[22] Filed: Jan. 22, 1979

[30] Foreign Application Priority Data

Jan. 20, 1978 [JP] Japan ..... 53-4388

[51] Int. Cl.[3] ..... H04R 9/06

[52] U.S. Cl. ..... 179/115.5 VC

[58] Field of Search ..... 179/115.5 VC

[56] References Cited

U.S. PATENT DOCUMENTS

| | | | |
|---|---|---|---|
| 2,275,598 | 3/1942 | Anorus | 179/115.5 VC |
| 2,640,556 | 6/1953 | Brennan | 179/115.5 VC |

*Primary Examiner*—James W. Moffitt

*Attorney, Agent, or Firm*—Craig and Antonelli

[57] ABSTRACT

A spider of loudspeaker having a base material in the form of a plain-woven fabric of warps and wefts each of which constituted by fibers of an inorganic material. The warps and wefts are coated with a thermosetting resin which in turn is coated with a thermoplastic resin. The spider thus formed is less liable to absorb the ambient moisture and, therefore, is free from distortion.

4 Claims, 5 Drawing Figures

SPIDER OF LOUDSPEAKER

BACKGROUND OF THE INVENTION

The present invention relates to a spider adapted to support the diaphragm and the voice coil of a loudspeaker for free vibration.

As is well known to those skilled in the art, a moving coil type loudspeaker has a voice coil bobbin around which wound is a voice coil. The voice coil bobbin is disposed in the annular magnet air gap of a magnetic circuit, and is mechanically connected to a diaphragm such that the voice coil bobbin vibrates together with the diaphragm.

The voice coil bobbin and the diaphragm are supported by a spider for free vibration. During the use of the loudspeaker, the voice coil vibrates in the axial direction thereof within the annular magnetic gap. Therefore, the spider is required to flexibly follow the axial movement of the voice coil, so as not to hinder the axial vibration of the voice coil, while fixing the voice coil with a large rigidity against movement in a direction perpendicular to the direction of vibration of the voice coil, so as to hold the voice coil always at the annular magnetic air gap.

At the same time, the spider is required to freely expand and shrink to accommodate even a large amplitude of vibration of the diaphragm and the voice coil, preferably in a linear manner.

A typical conventional process for manufacturing the spider is as follows. At first, a woven fabric of cotton or the like material is shaped into a disc. The disc is impregnated with phenol resin and then heated and compressed to have a number of concentric pleats or undulations, so as to exhibit a corrugated cross-section. Subsequently, a bore for receiving the top of the diaphragm or the voice coil bobbin is formed at the center of the disc-shaped spider. Finally, the top of the diaphragm or the voice coil bobbin is attached to the circumference of the bore of the disc-shaped spider which in turn is fixed at its peripheral portion to the frame, such that the diaphragm and the voice coil bobbin are supported for free vibration.

This conventional spider, however, poses the following problems. Namely, though the woven fabric of cotton or the like, which constitutes the spider, is impregnated with phenol resin, the woven fabric is liable to absorb ambient moisture which reduces its rigidity to such an extent that it can no longer support the diaphragm and the voice coil. As a result, the voice coil is inconveniently deviated from the correct position in the air gap.

In order to obviate the above described problem, it has been proposed to fabricate the spider from fibers of polyester resin, which is less liable to absorb moisture, impregnated with a thermosetting resin such as phenol resin. However, since the polyester resin is thermoplastic, the fibers are softened when released from the shaping pressure, because of the high temperature at which the shaping is effected, so that the spider cannot maintain its shape. In order to avoid this softening of the material fibers, it is necessary to cool the spider while maintaining the shaping pressure, subsequent to the shaping which is made at a high temperature, until the fibers are sufficiently hardened. Consequently, the time required for the production of the spider is impractically prolonged.

SUMMARY OF THE INVENTION

It is therefore an object of the invention to provide a spider of loudspeaker, which is less liable to absorb moisture and, accordingly, less liable to be distorted.

It is another object of the invention to provide a spider of a loudspeaker, which can be shaped in a shorter period of time.

To these ends, according to the invention, there is provided a spider of a loudspeaker having the following features.

Namely, according to the invention, a plain-woven fabric is woven from warps and wefts each of which is made of inorganic fibers surface-treated with an organic silicon compound. The fabric is then impregnated with a thermosetting resin which is diluted by a solvent, and is pre-cured after the drying of the solvent. The inorganic warps and wefts constituting the fabric are fastened to each other at their crossings, as a result of this pre-curing. After the completion of the pre-curing, the fabric is impregnated with natural or synthetic rubber diluted by a solvent or with the liquid of a thermoplastic resin which is also diluted by a solvent. Alternatively, one of these solutions is applied to both faces of the fabric. Subsequently, after the drying of the solvent, the fabric is shaped under the presence of predetermined shaping pressure and temperature. Since the spider thus produced is constituted by inorganic fibers, it is less likely to absorb the moisture and can maintain its shape, so as to hold the voice coil correctly at the center of the air gap, even after a long use.

DESCRIPTION OF THE PREFERRED EMBODIMENTS

These and other objects, as well as advantageous features of the invention will become more clear from the following description of the preferred embodiments taken in conjunction with the accompanying drawings.

Figure 1:
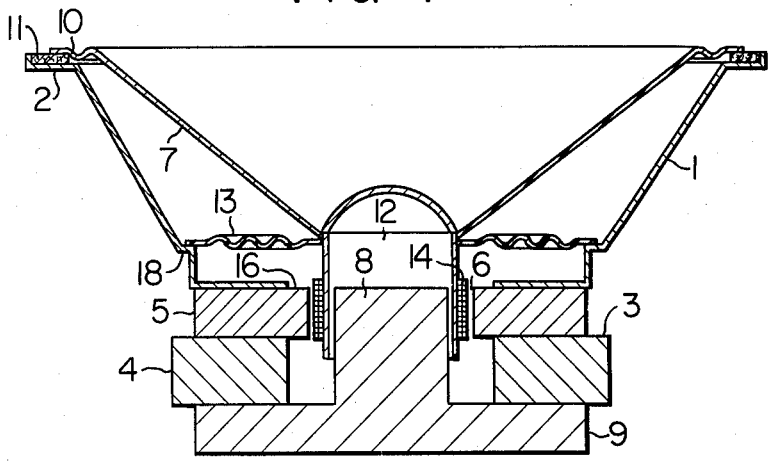
FIG. 1 is a sectional view of a loudspeaker incorporating a spider of the invention.

Referring first to FIG. 1 showing in section a loudspeaker incorporating a spider of the invention, the loudspeaker has a conical frame 1 provided at its upper opening end with a peripheral flange 2. The conical frame 1 is connected at its lower end to a magnetic circuit 3 which includes an annular ferrite magnet 4. A first yoke 5 having a central bore is bonded to the upper surface of the magnet 4, while a second yoke 9 having a central pole 8 is bonded to the lower surface of the magnet 4. Thus, the magnetic circuit 3 has a magnetic air gap 6 which is defined between the inner periphery of a pole 16 of the first yoke 5 and the outer periphery of the center pole 8. The air gap 6 receives a cylindrical voice coil bobbin 12 around which is wound a voice coil 14.

To the upper ends of the voice coil bobbin 12, bonded are the top of a conical diaphragm 7 and a spider 13. The diaphragm 7 has a peripheral supporting member 10 integral therewith. The supporting member 10 is bonded to a ring-shaped cardboard 11 which in turn is bonded to the upper surface of the flange 2.

Figure 2:
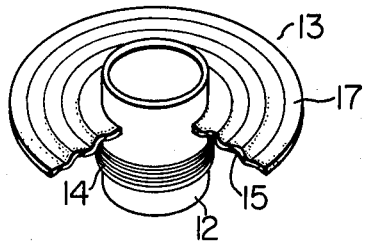
FIG. 2 is a perspective view of a spider of the invention, with a portion thereof removed.

As will be seen from FIG. 2, the spider 13 has a disc-like shape having a central bore for receiving the voice coil bobbin 12. At the same time, the spider 13 is provided with a number of concentric pleats or undulations 15, so as to exhibit a corrugated cross-section. The spider further has a flattened peripheral fixing portion 17 by means of which it is bonded to a flange 18 formed at the lower end of the frame 1.

The voice coil bobbin 12 is received by the central bore of the spider 13, and is bonded at its outer peripheral surface to the inner peripheral edge of the central bore of the spider 13. The voice coil bobbin inserted into the air gap 6 is supported by the spider 13 such that it is always held concentrically with the center pole 8, and that the voice coil 14 wound around the voice coil bobbin 12 is disposed in the air gap 6.

The spider 13 is made from a base material which is made of a woven fabric constituted by plain-woven warps and wefts of inorganic fibers such as glass fibers, carbon fibers or the like. This base material is most clearly shown in FIG. 5.

Figure 5:
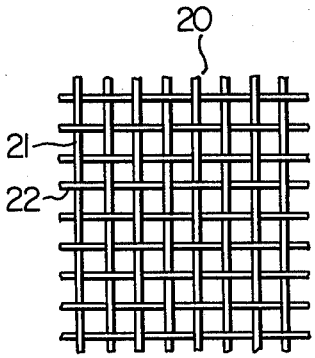
FIG. 5 is a plan view of a base material of the spider of the invention.

More specifically, referring to FIG. 5, the base material 20 has a plurality of warps 21 and wefts 22 which are woven in a manner called plain weaving. Each warp and weft is constituted by a bundle of about 30 glass fiber elements, each having a diameter of 9 $\mu$m, twisted 3.8 times per inch. The warps 21 and wefts 22 are beforehand made to pass through a solution of an organic silicon compound, for a surface treatment. Then, the warps 21 and wefts 22 are plain-woven such that they alternatingly overlie and underlie each other. In the woven base material, 20 (twenty) warps 21 and 20 (twenty) wefts 21 are included by 1 (one) inch length in respective orthogonal directions.

Figure 3:
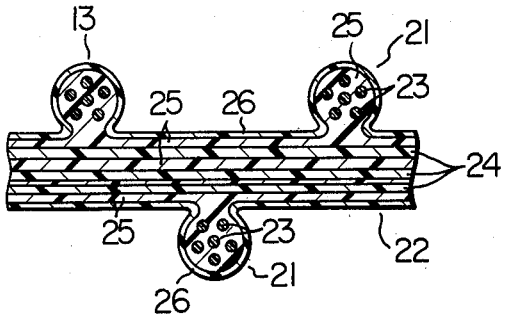
FIG. 3 is an enlarged sectional view of a portion of a spider constructed in accordance with an embodiment of the invention.

FIG. 3 shows in section, in a larger scale, a part of the spider which consists of the woven base material coated with a synthetic resin. It will be seen that glass fibers 23 constituting the warp 21 and the glass fibers 24 constituting the wefts 22 cross one another. The glass fibers 23 constituting the warp 21 and the glass fibers 24 constituting the weft 22 are coated directly with a thermosetting resin 25. This thermosetting resin 25 in turn is coated with a soft thermoplastic resin 26 applied to the surface thereof. The thermosetting resin 25 is formed from a solution obtained by mixing a dihydric phenol resin with an organic solvent which is an admixture of methyl ethyl ketone and toluene mixed at a rate of 7:3 by volume, such that the density of the resin in the solution is 15% by weight.

In the manufacture of the spider, the woven base material 20 is immersed in this solution, so that the bundles of the glass fibers 24, 25 are sufficiently impregnated with the thermosetting resin 25. Then, the base material 20 is taken out of the solution, and is left at the room temperature for 2 to 3 minutes, until the solvent is evaporated. The glass fibers 24, 25 are thus coated with the thermosetting resin 25. After the evaporation of the solvent of the thermosetting resinous solution with which the base material 20 is impregnated, the base material 20 is left in an atmosphere of 80° C., for 5 to 10 minutes, thereby to effect a pre-curing, so as to half harden the thermosetting resin.

The aforementioned thermoplastic resin 26 is made from a solution which is obtained by adding 20% by volume of water to a copolymer of vinyl acetate and ethylene, and then stirring. The pre-cured base material 20 is immersed in this solution, so that the thermosetting resin 25 on the glass fibers is attached by and coated with the thermoplastic resin 26. Then, the base material 20 is taken out of the solution of the thermoplastic resin, and is left in an atmosphere of 60° to 80° C. for five minutes, for evaporation of the water content.

Subsequently, the base material 20 is placed between an upper and a lower molds each of which have a plurality of circular concentric corrugations, and is pressed by these molds under a shaping pressure of 2 Kg/cm$^2$ at a shaping temperature of 200° to 250° C., for 30 seconds, so that the thermosetting resin is hardened. The spider 13 is thus formed. The warps and wefts are fastened to each other at their crossings by the hardened thermosetting resin 25. Since these crossings are coated with the thermoplastic resin, no separation or unfastening of the warps and wefts from each other can take place at the crossings.

Figure 4:
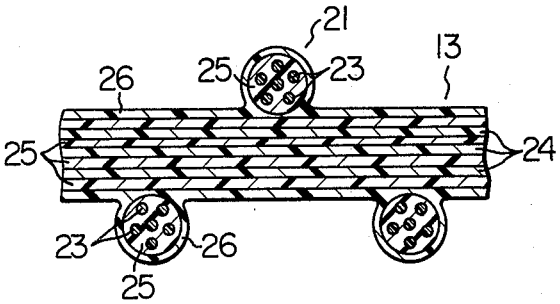
FIG. 4 is an enlarged sectional view of a portion of a spider constructed in accordance with another embodiment of the invention.

FIG. 4 shows another example of the spider manufactured by the following process. Namely, for the manufacture of this spider, the base material 20 is stretched, after the coating with the thermosetting resin 25, obliquely upwardly in the 45° direction, so that the connections between warps 21 and wefts 22 are broken at their crossings, so as to separate the warps 21 and wefts 22. Then, the warps and wefts coated with the thermosetting resin, in the separate state, are further coated with the thermoplastic resin 26. Thus, in this example, the warps 21 and wefts 22 are fastened to each other by means of the thermoplastic resin 26. In this case, a stronger fastening of the warps 21 and wefts 22 to each other is obtained, because the thermoplastic resin 26 is a soft resin.

Then, the aforementioned central bore is formed in the thus formed spider 13, and the voice coil bobbin 12 is inserted into this central bore.

The thermosetting resin 25 and the thermoplastic resin 26 with which the woven base material 20 is coated can be obtained from the following mixtures.

(1)

thermosetting resin:

Resol type phenol resin and novolak type epoxy resin are mixed with each other at a ratio of 3:1 by weight.

solvent: methyl ethyl ketone

The thermosetting resin is mixed with the solvent at a ratio of 20:80 by weight.

thermosplastic resin:

ester acrylate

The thermoplastic resin is mixed with water at a ratio of 8:2 by weight.

(2)

Thermosetting resin:

Resol type phenol resin and nitrile rubber are mixed at a ratio of 8:1 by weight.

solvent: ethyl alcohol

The thermosetting resin and the solvent are mixed at a rate of 30:70 by weight.

thermoplastic resin: copolymer of ethylene and vinyl acetate

The thermoplastic resin is mixed with water at a ratio of 8:2 by weight.

The spider of the invention thus manufactured can stand a longer use without suffering distortion, because it is made of a base material constituted by inorganic fibers which are less liable to absorb the ambient moisture and, accordingly, can hold the voice coil correctly at the center of the air gap over a long time of use. The large number of concentric pleats or corrugations are well maintained by the hardened thermosetting resin, while the thermoplastic resin prevents the separation of the warps and wefts as well as the breakage of the inorganic fibers.

It is possible to use carbon fibers as the inorganic fibers, in place of the described glass fibers.

What is claimed is:

1. A spider of a loudspeaker comprising:

a spider base material including a plurality of warp yarns and a plurality of weft yarns formed of a bundle of a plurality of inorganic fibers, said plurality of warp yarns being disposed in substantially parallel, spaced relation to one another and said plurality of weft yarns also being disposed in substantially parallel, spaced relation to one another, and said plurality of warp yarns and said plurality of weft yarns being arranged to cross one another in a plain-weave;

a thermosetting synthetic resinous material coating applied to said plurality of warp yarns and said plurality of weft yarns of said spider base material in a manner to provide a gap between the adjacent warp yarns and between the adjacent weft yarns and so as to connect the warp yarns and the weft yarns together at the crossings;

a thermoplastic synthetic resinous material coating applied to the surface of said thermosetting synthetic resinous material coating; and a plurality of corrugations in the form of concentric circles formed in said spider base material, having said thermosetting synthetic resinous material coating and said thermoplastic synthetic resinous material coating, by heating and pressing.

2. A spider of a loudspeaker comprising:

A spider base material including a plurality of warp yarns and a plurality of weft yarns formed of a twisted bundle of a plurality of inorganic fibers, said plurality of warp yarns being disposed in substantially parallel, spaced relation to one another and said plurality of weft yarns also being disposed in substantially parallel, spaced relation to one another and said plurality of warp yarns and said plurality of weft yarns being arranged to cross one another in a plain-weave;

a plurality of thermosetting synthetic resinous material coatings each coating being individually applied to the surfaces of one of said plurality of warp yarns and said plurality of said weft yarns of said spider base material in a manner to provide a gap between the adjacent warp yarns and between the adjacent weft yarns, without connecting the warp yarns and the weft yarns to one another at the crossings;

a thermoplastic synthetic resinous material coating applied to the surfaces of said thermosetting resinous material coatings in a manner to provide a gap between the adjacent warp yarns and between the adjacent weft yarns of said spider base material, and so as to connect the warp yarns and the weft yarns together at the crossings; and a plurality of corrugations in the form of concentric circles formed in said spider base material, having said thermosetting synthetic resinous material coatings and said thermoplastic synthetic resinous material coating, by heating and pressing.

3. A spider according to claim 1 or 2 wherein said inorganic fibers are carbon fibers.

4. A spider of a loudspeaker comprising:

a spider base material including a plurality of warp yarns and a plurality of weft yarns formed of a bundle of a plurality of glass fibers which have been subjected to a surface treatment with an organic silicon compound, said plurality of warp yarns being disposed in substantially parallel, spaced relation to one another and said plurality of weft yarns also being disposed in substantially parallel, spaced relation to one another, and said plurality of warp yarns and said plurality of weft yarns being arranged to cross one another in a plain-weave;

a thermosetting synthetic resinous material coating applied to the surfaces of said plurality of glass fibers constituting said warp yarns and said weft yarns of said spider base plate in a manner to provide a gap between the adjacent warp yarns and between the adjacent weft yarns and so as to connect the warp yarns and the weft yarns together at the crossings;

a thermoplastic synthetic resinous material coating applied to the surface of said thermosetting synthetic resinous material coating; and a plurality of corrugations in the form of concentric circles formed in said spider base material having said thermosetting synthetic resinous material coating and said thermoplastic synthetic resinous material coating by heating and pressing.

* * * * *